US006421028B1

(12) United States Patent
Öhgren et al.

(10) Patent No.: US 6,421,028 B1
(45) **Date of Patent: *Jul. 16, 2002**

(54) DUAL FREQUENCY QUADRIFILAR HELIX ANTENNA

(75) Inventors: Mikael Öhgren, Göteborg; Stefan Johansson, Rommelanda, both of (SE)

(73) Assignee: SAAB Ericsson Space AB, Göteborg (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/581,080

(22) PCT Filed: Nov. 25, 1998

(86) PCT No.: PCT/SE98/02135

§ 371 (c)(1),
(2), (4) Date: Jul. 19, 2000

(87) PCT Pub. No.: WO99/33146

PCT Pub. Date: Jul. 1, 1999

(30) Foreign Application Priority Data

Dec. 19, 1997 (SE) ..... 9704817

(51) Int. Cl.[7] ..... H01Q 1/36
(52) U.S. Cl. ..... 343/895; 343/850

(58) Field of Search ..... 343/895, 850, 343/702, 891

(56) References Cited

U.S. PATENT DOCUMENTS

| | | | | | |
|---|---|---|---|---|---|
| 5,349,365 | A | | 9/1994 | Ow et al. | 343/895 |
| 5,872,549 | A | * | 2/1999 | Huynh et al. | 343/895 |
| 5,909,196 | A | * | 6/1999 | O'Neill, Jr. | 343/895 |
| 6,184,845 | B1 | * | 2/2001 | Leisten et al. | 343/895 |

FOREIGN PATENT DOCUMENTS

| | | | |
|---|---|---|---|
| EP | 0 465 658 A1 | 1/1992 | H01Q/11/08 |
| WO | WO 97/01196 | 1/1997 | H01Q/11/08 |

* cited by examiner

*Primary Examiner*—Don Wong
*Assistant Examiner*—James Clinger
(74) *Attorney, Agent, or Firm*—Swidler Berlin Shereff Friedman, LLP

(57) ABSTRACT

A mechanically simple dual-frequency (or wide band) quadrifilar helix antenna (1). It includes four helix shaped radiating elements (2–5) where each helix element consists of two or more parallel helices (2*a*, 2*b*, 3*a*, 3*b*, 4*a*, 4*b*, 5*a*, 5*b*) of different lengths that are in galvanic contact at, or close to, the feeding point (2*c*, 3*c*, 4*c*, 5*c*). The four feeding points (2*c*, 3*c*, 4*c*, 5*c*) of the helix elements (2–5) are located at the bottom of the helix, meaning that the feedings of the helix elements are located at the end (6) of the helix pointing in the direction opposite to the direction of its main radiation.

22 Claims, 8 Drawing Sheets

DUAL FREQUENCY QUADRIFILAR HELIX ANTENNA

FIELD OF THE INVENTION

The present invention relates to radio frequency antennas or more specifically to quadrifilar helix antennas.

BACKGROUND OF THE INVENTION

A quadrifilar helix antenna typically consists of four symmetrically positioned helix shaped metallic wire of strip elements. The four helices are fed in phase quadrature, i.e. with equal amplitude and with the phase relation 0°, 90°, 180° and 270°. The quadrifilar helix antenna can receive and transmit circular polarised signals over a large angular region. Its radiation characteristics is determined mainly by the shape of the helices, i.e. the number of turns, pitch angle, antenna height and antenna diameter, and in the case of conical shaped helices also the cone angle.

The phase quadrature feeding of the four helices can be accomplished in different manners. One possibility is to have a separate feeding network that generates the phase quadrature. Alternatively a balun system can be used combined with a separate 90°-hybrid or with a self-phasing helix antenna.

A difficulty with the traditional quadrifilar helix antenna is its relatively strong frequency dependent input impedance. This makes it difficult to design broad band matched or dual-frequency matched antennas. However, this problem can be solved to some extent by having a double tuned quadrifilar helix antenna.

Dual frequency quadrifilar helix antennas are frequently requested for many applications commonly for the purpose of having separate frequency bands for receiving signals and for transmitting signals.

For mobile satellite communication system, dual-frequency circularly polarised antennas are requested for the use on hand held terminals. These antennas are designed to operate at L- or S-band with a coverage over a cone with a half angle between 40° up to 90° depending on the system.

One object of the invention is to provide a novel compact dual-frequency quadrifilar helix design that has the potential of low cost mass production A second object is to provide a dual-frequency quadrifilar helix antenna design that makes a simple mechanical design possible and suitable for space applications.

SUMMARY OF THE INVENTION

The present invention is a mechanically simple dual-frequency (or wide band) quadrifilar helix antenna. It includes four helix shaped radiating elements where each helix element consists of two or more parallel helices of different lengths that are in galvanic contact at, or close to, the feeding point. The four feeding points of the helix elements are located at the bottom of the helix, meaning that the feedings of the helix elements are located at the end of the helix pointing in the direction opposite to the direction of its main radiation.

The present invention also includes a compact dual-frequency (or wide band) quadrifilar design with an integrated feeding network (power distribution network). In this case the four feeding points of the helix elements are connected via small matching sections to a distributed series feeding network consisting of transmission lines that serves for the phase quadrature feeding of the four helix elements, yielding a single input feeding point for the complete antenna assembly. The matching section and the series feeding network is preferably realised in stripline or microstrip techniques.

By providing a quadrifilar helix antenna of the suggested design it becomes a very attractive candidate for use in mobile satellite communication systems as an example, but it requires a compact dual-frequency design with an integrated feeding network that is simple from a manufacturing point of view.

Further, in mobile satellite communication systems a dual-frequency design is very attractive as it is simple from a manufacturing point of view. Very often a simple mechanical design means a safe design for space applications.

Quadrifilar helix antennas can also be used in applications as transmission and/or receiving antennas on board satellites.

EMBODIMENTS OF THE INVENTION

Figure 1:
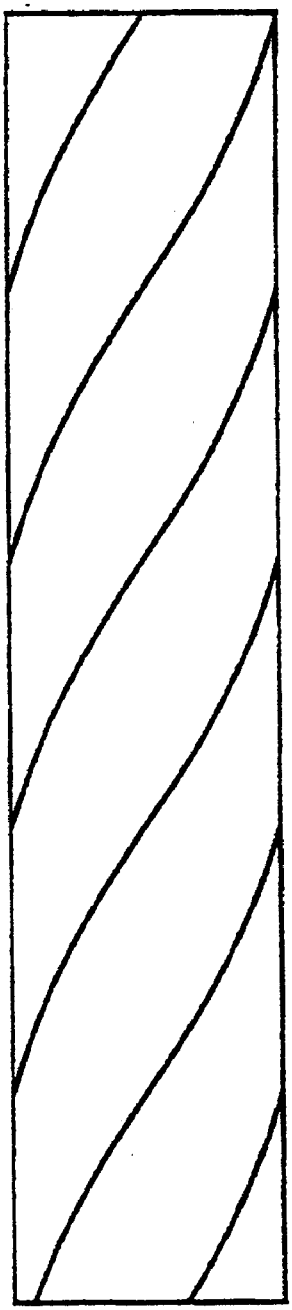
FIG. 1 is a side view of a conventional cylindrical quadrifilar helix antenna

FIG. 1 is a side view of a cylindrical quadrifilar helix antenna constructed in accordance with conventional teachings of the prior art. The four helices can be fed in phase quadrature, i.e. with equal amplitude and with the phase relation 0°, 90°, 180° and 270°, either at the bottom or at the top of the quadrifilar helix. Where the helices are fed and how the phase quadrature feedings is accomplished is not shown in the figure.

Figure 3:
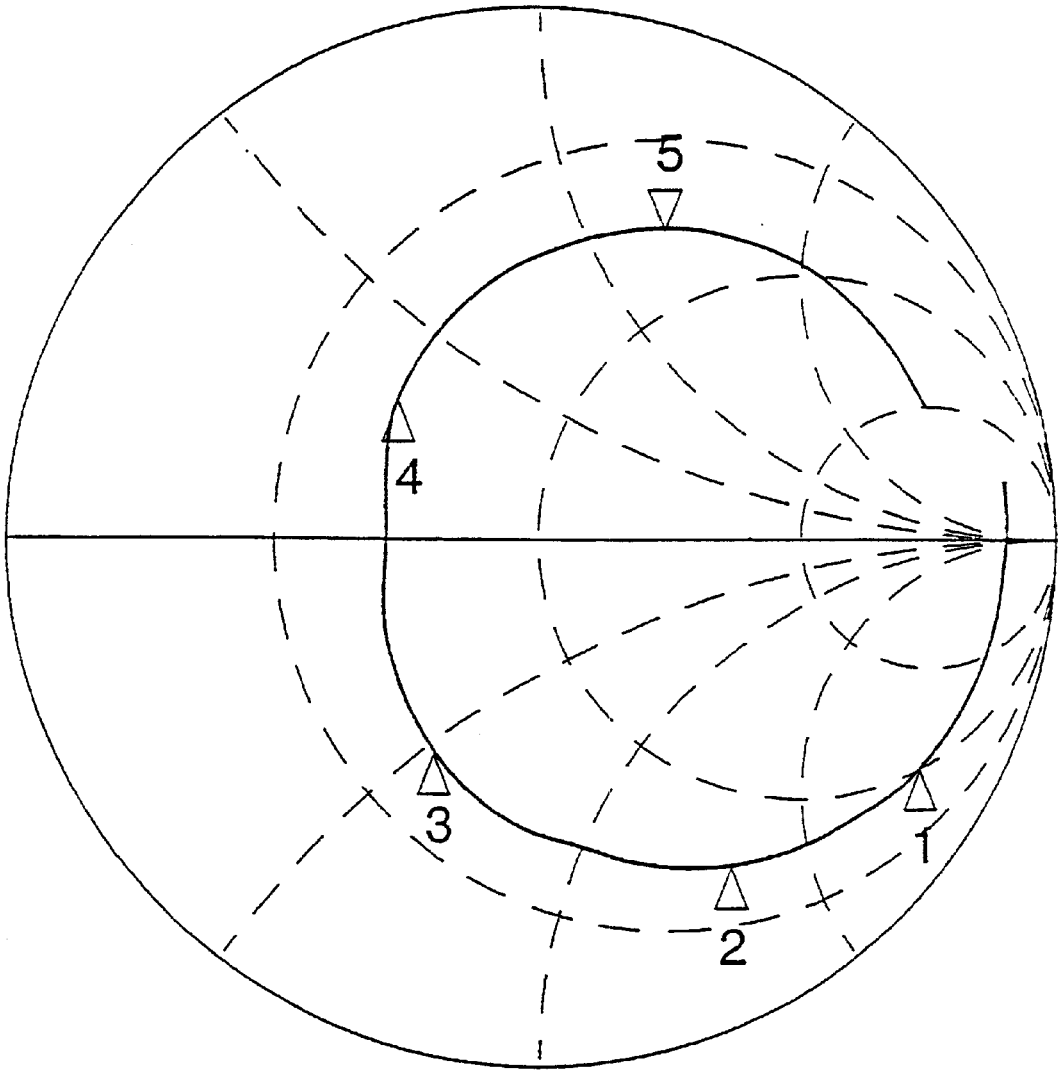
FIG. 3 is a Smith chart showing the active input impedance of a conventional cylindrical quadrifilar helix antenna.

FIG. 3 shows a Smith chart of a typical active input impedance as a function of frequency for a conventional cylindrical quadrifilar helix antenna Assuming that the antenna is to operate at two separate frequency bands, where one frequency band is between marker 1 and 2 and the other between marker 3 and 4 in FIG. 3, it follows that the active input impedance is very different between the two frequency bands. This will make it extremely difficult to obtain a good and simple impedance matching between the quadrature helix antenna and its feed network.

Figure 2:
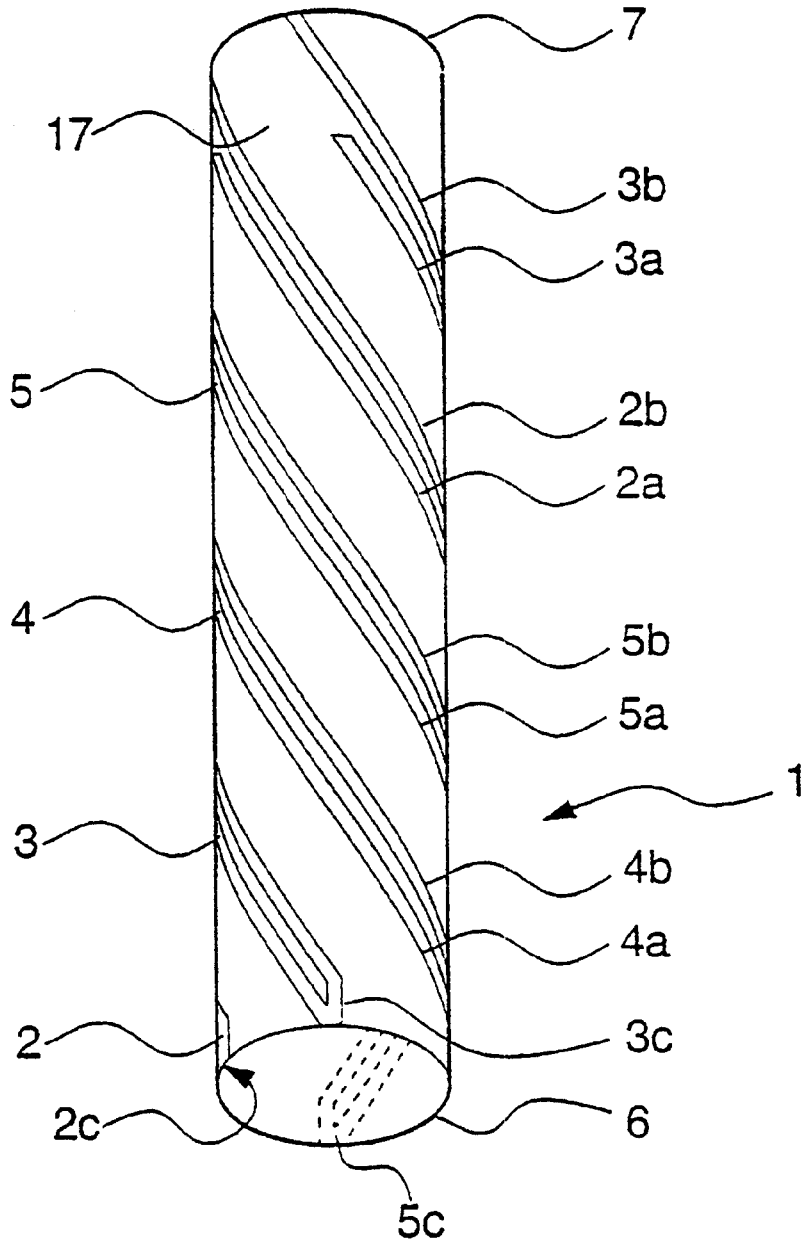
FIG. 2 is a perspective view of a dual frequency quadrifilar helix antenna, feeding network excluded, in accordance with one aspect of the present invention.

FIG. 2 shows a perspective view of a dual frequency quadrifilar helix antenna 1, a feed network for feeding the antenna excluded, in accordance with the teaching of the present invention. The antenna consists of four helix shaped radiating elements 2–5, where in contrast to the conventional quadrafilar helix antenna, each helix element consists of two parallel helices 2*a*, 2*b*, 3*a*, 3*b*, 4*a*, 4*b*, 5*a*, 5*b* of different lengths that are in galvanic contact close to its feed point The four feed points 2*c*–5*c* of the helix elements 2–5 are located at the bottom 6 of the helix, meaning that the feedings of the helix elements 2–5 are located at the end of the helix pointing in the direction opposite to the direction of its main radiation. Having the feed points 2–5 located at the bottom 6 of the helix makes it possible to provide a mechanically simple design, where a feed network can easily be added below the radiating helix pat The four helix elements 2–5 in FIG. 2 are open circuited in the top of the helix, but an alternative is to have them short circuited. However, with open circuited helix elements the design becomes much simpler from a manufacturing point of view.

Figure 4:
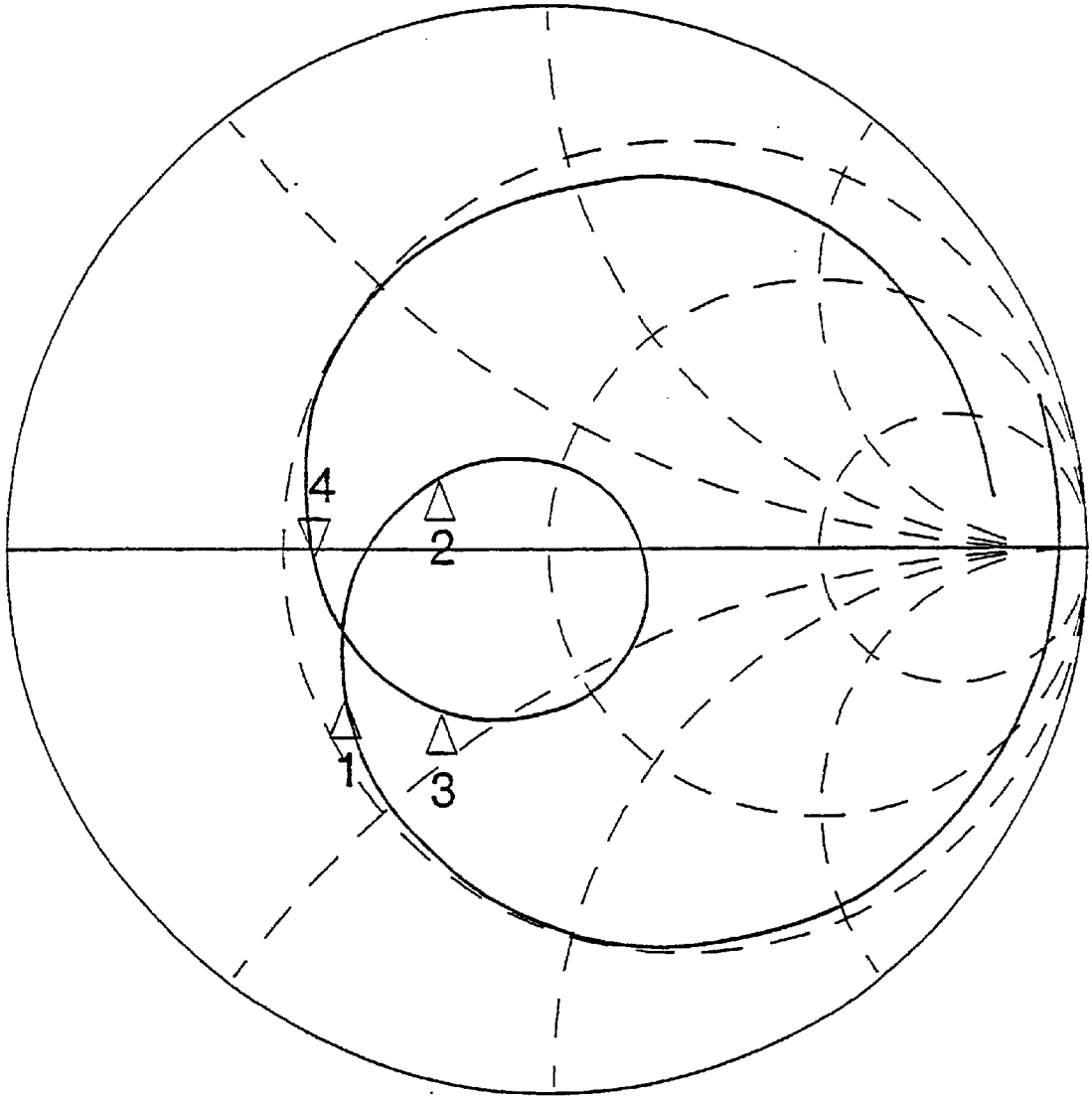
FIG. 4 is a Smith chart showing the active input impedance of a cylindrical quadrifilar helix antenna in accordance with the teaching of the present invention.

FIG. 4 shows a Smith chart of a typical active input impedance as a function of frequency for a quadrifilar helix antenna in accordance with one aspect of the present invention. The effect of letting each helix element 2–5 consist of two parallel helices 2*a*, 2*b*, 3*a*, 3*b*, 4*a*, 4*b*, 5*a*, 5*b* of different lengths that are in galvanic contact close to its feed points 2*c*–5*c* is that we can now have the active input impedance to basically be the same for two separate frequency bands, one frequency band is between markers Δ1 and Δ2 and the other between markers Δ3 and Δ4 as shown in FIG. 4. This makes a much simpler design possible for the impedance matching between the quadrifilar helix antenna 1 and its feed network 12.

Figure 5:
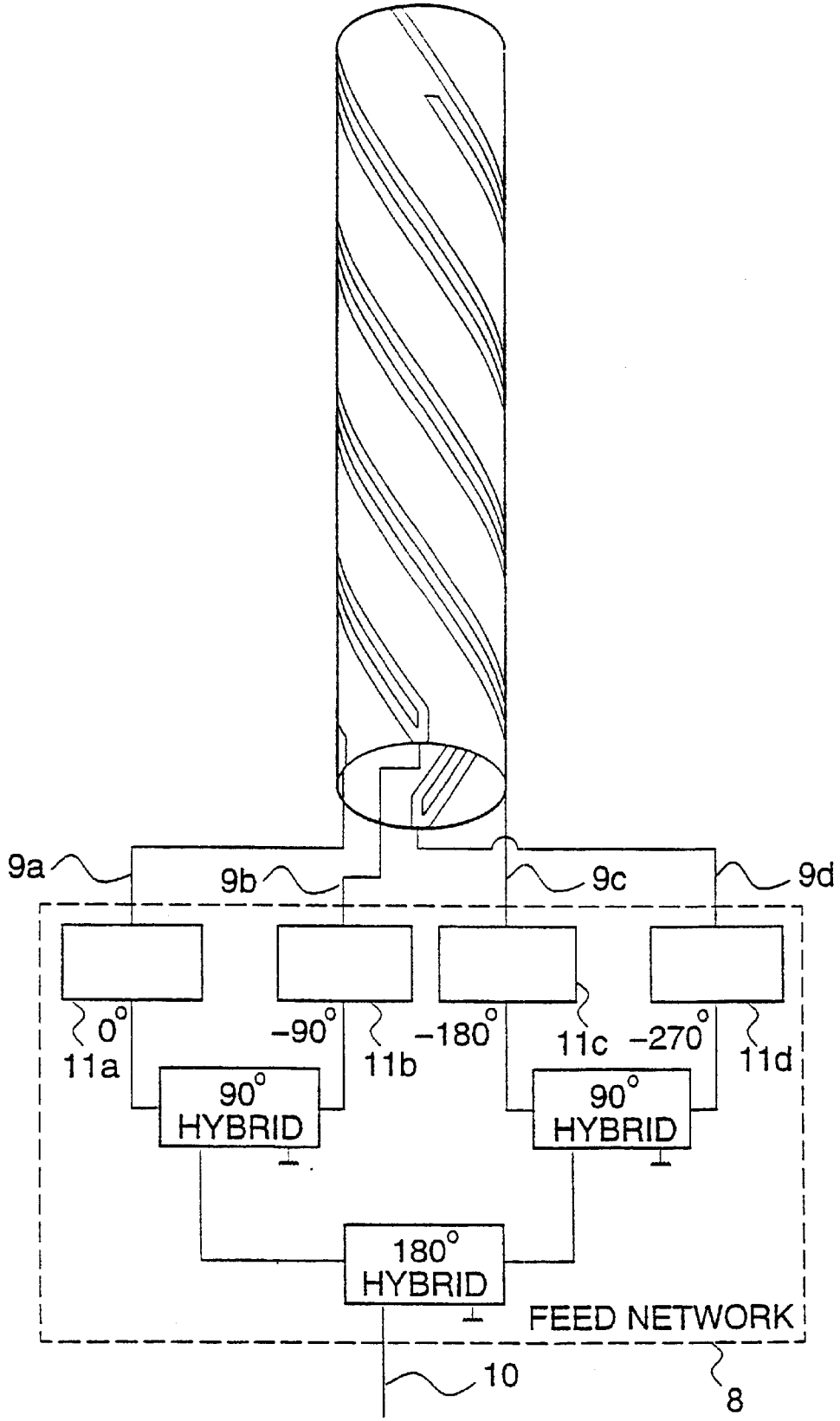
FIG. 5 is a block diagram showing a hybrid feed network with four output ports feeding a dual frequency quadrifilar helix antenna in phase quadrature via four matching sections, yielding a single input feed point for the complete antenna assembly with the other hybrid ports being terminated with resistive loads.

FIG. 5 shows a block diagram of a hybrid feed network 8 with four output ports 9*a*–9*d* feeding a dual frequency quadrifilar helix antenna 1 in phase quadrature via four matching sections 11*a*–11*d*, yielding a single input feed point 10 for the complete antenna assembly with the other hybrid ports being terminated with resistive loads. The four matching sections 11*a*–11*d* can be excluded or replaced by transmission lines if appropriate. The hybrid feed network 8 can be realised in either stripline or microstrip techniques or in a combination. The feed network 8 and the matching sections 11*a*–11*d* can be placed in a separate box located, for instance, below the quadrifilar helix.

Figure 6:
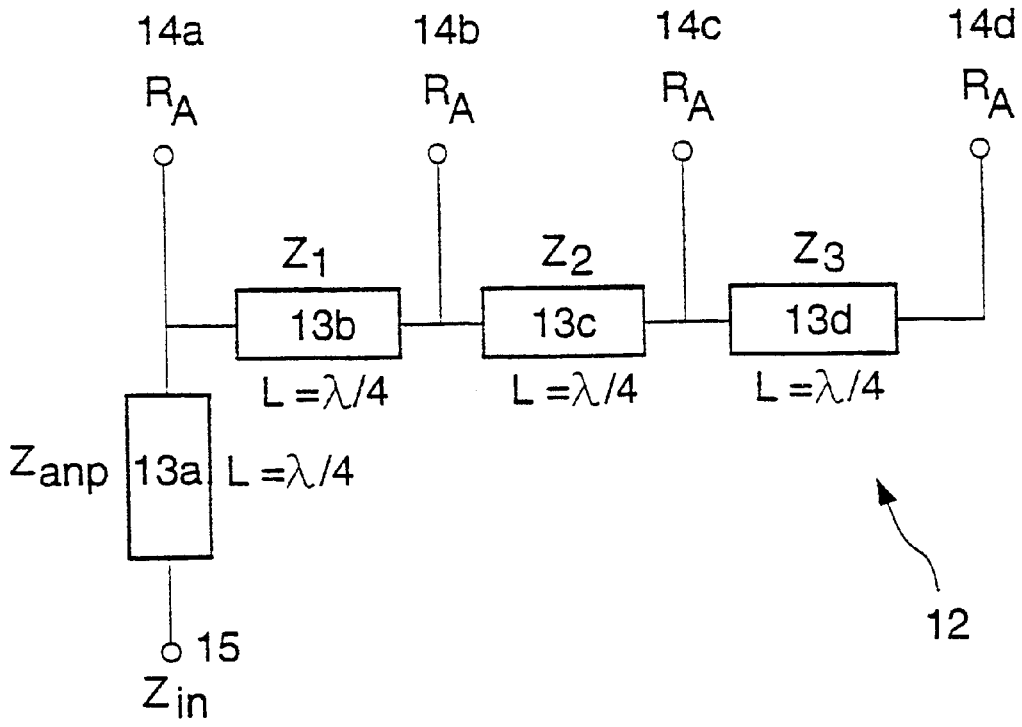
FIG. 6 is a schematic view of a distributed series feed network consisting of transmission lines with four output ports and one input port, yielding four output signals with equal amplitude and with a relative phase relation of 0°, 90°, 180° and 270°, when feeding the input connector.

FIG. 6 shows a schematic view of a distributed series feed network 12 consisting of transmission lines 13*a*–13*d* with four output ports 14*a*–14*d* and one input port 15, yielding four output signals with equal amplitude and with a relative phase relation of 0°, 90°, 180°, 270° when feeding the input port 15. In the figure L corresponds to the length of the transmission lines 13*a*–3*d* in wavelengths. $R_A$ is the input impedance from a helix and Z is the characteristic impedance of transmission lines 13*a*–13*d*.

Figure 7:
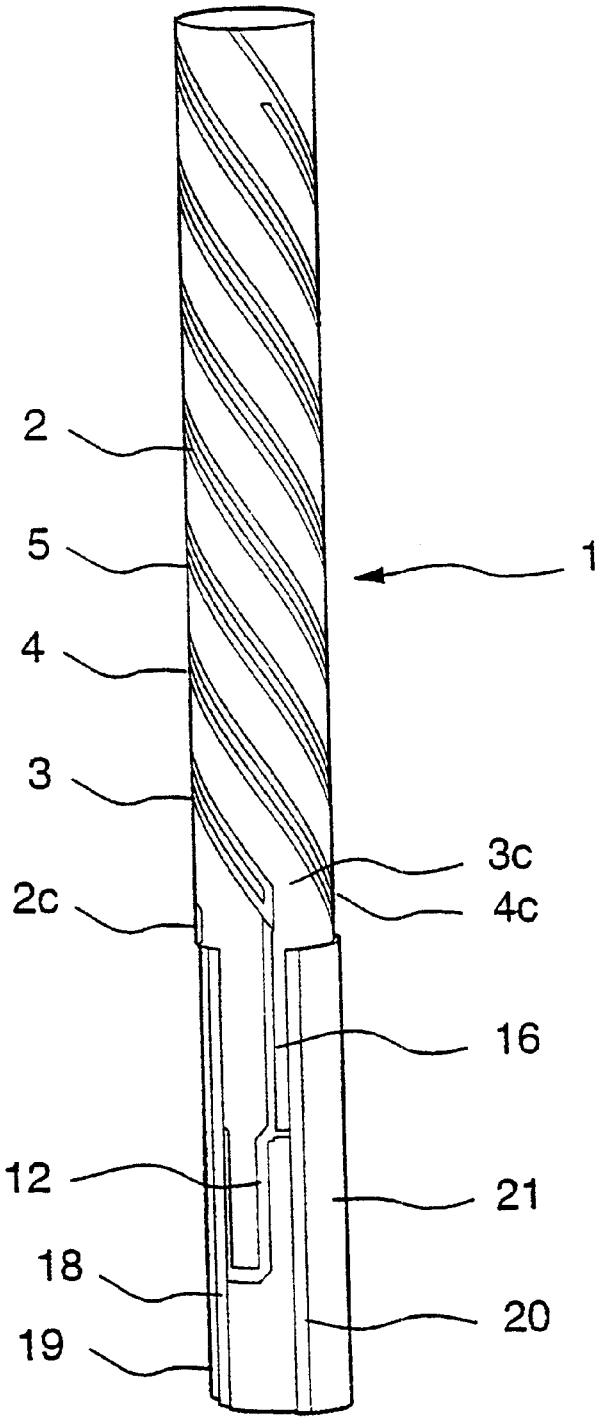
FIG. 7 is a partial sectional view of a dual-frequency quadrifilar helix antenna with an integrated feed network in accordance with the teaching of the present invention.

FIG. 7 shows a partial sectional view of a dual-frequency quadrifilar helix antenna 1 with an integrated feed network 12 in accordance with the reaching of the present invention. In the antenna design of FIG. 7, the four feed points 2*c*–5*c* of the helix elements 2–5 are connected via small matching sections 16 to a distributed series feed network 12 consisting of transmission lines. The matching sections 16 and the series feed network 12 is realised in stripline technique. Due to the double tuned helix design the matching between the feed network 12 and the radiating quadrifilar helix antenna 1 is easily obtained for both frequency bands using simple matching sections 16. The distributed series feed network 12 is of the type schematically viewed in FIG. 6.

One advantage of the antenna shown in FIG. 7 is that it is mechanically simple containing, few parts. As an example, the four double tuned helix elements 2–5, the four matching sections 16 and the distributed series feed network 12 can be printed or etched on a single dielectric tube.

Figure 8:
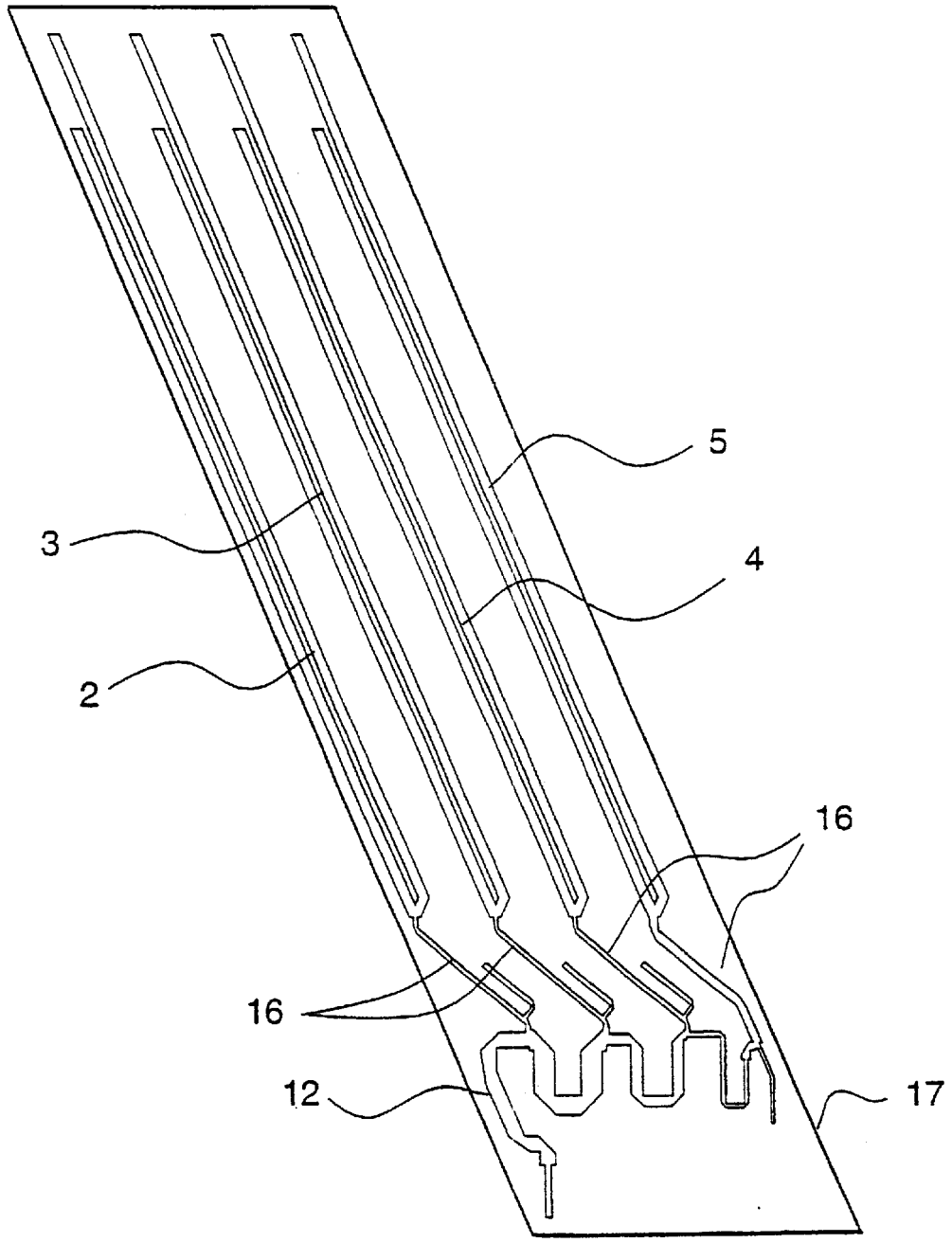
FIG. 8 is a plan view of a substrate containing printed pattern of four double tuned helix elements, four matching sections, and a distributed serial feed network, in accordance with the teaching of the present invention.

FIG. 8 shows a plan view of a dielectric substrate 17 containing a printed or etched pattern including the four double tuned helix elements 2–5, the matching sections 16 and distributed series feed network 12. Basically, the complete antenna design of FIG. 7 can be obtained by rolling the dielectric substrate 17 to a tube. The matching sections 16 and the feed network 12 is thereafter coated with an inner dielectrica 18, an inner groundplane 19, an outer dielectrica 20 and finally an outer groundplane 21 in the described order.

What is claimed is:

1. An antenna device, comprising:

four antenna elements symmetrically arranged about and extending along a cylinder, each antenna element comprising a group of at least two parallel helices, each group of helices comprising a first radiative end and a second feed end opposite the first end, each member of each group of helices extending a different distance along the cylinder than other members of its group of helices and being galvanically connected close to the second end.

2. The antenna device according to claim 1, wherein the helices are etched on a skin having a cylindrical or a conical shape.

3. The antenna device according to claim 1, wherein the helices are printed on a skin having a cylindrical or a conical shape.

4. The antenna device according to claim 1, wherein the helices are open circuited at the first end.

5. The antenna device according to claim 1, further comprising:

a feed network to which the antenna elements are each connected, the feed network comprising transmission lines operable to serve as a phase quadrature feeding of the antenna elements and to yield a single feed input feed point for the antenna device.

6. The antenna device according to claim 5, further comprising:

matching sections operable to connect the antenna elements to the feed network.

7. The antenna device according to claim 6, wherein the feed network, the matching sections, and the antenna elements are etched on one dielectric skin.

8. The antenna device according to claim 6, wherein the feed network, the matching sections, and the antenna elements are printed on one dielectric skin.

9. The antenna device according to claim 5, further comprising:

transmission lines operable to connect the antenna elements to the feed network.

10. The antenna device according to claim 5, wherein the feed network comprises a distributed feed network or a hybrid feed network.

11. The antenna device according to claim 5, wherein the feed network is realized in stripline technique or microstrip technique.

12. The antenna device according to claim 1, wherein the antenna device comprises a dual frequency or wide band quadrifilar helix antenna.

13. An antenna device, comprising:

a plurality of antenna elements symmetrically arranged about and extending along a cylinder, each antenna element comprising a group of at least two parallel helices, each group of helices comprising a first radiative end and a second feed end opposite the first end, the first end of each helix if each group lying at a different point on the cylinder than the other helices of its group, and each group of helices extending along substantially an entire length of the antenna device and being galvanically connected close to the second end.

14. The antenna device according to claim 13, wherein the antenna device comprises a quadrifilar helix antenna comprising four antenna elements.

15. The antenna device according to claim 13, wherein the helices are etched on a skin having a cylindrical or a conical shape.

16. The antenna device according to claim 13, wherein the helices are printed on a skin having a cylindrical or a conical shape.

17. The antenna device according to claim 13, wherein the helices are open circuited at the first end.

18. The antenna device according to claim 13, further comprising:

a feed network to which the antenna elements are each connected, the feed network comprising transmission lines operable to serve as a phase quadrature feeding of the antenna elements and to yield a single feed input feed point for the antenna device.

19. The antenna device according to claim 18, further comprising:

matching sections operable to connect the antenna elements to the feed network.

20. The antenna device according to claim 18, further comprising:

transmission lines operable to connect the antenna elements to the feed network.

21. The antenna device according to claim 18, wherein the feed network is a distributed feed network or a hybrid feed network.

22. The antenna device according to claim 13, wherein the antenna device comprises a dual frequency or wide band quadrifilar helix antenna.

* * * * *